United States Patent [19]

Lowe et al.

[11] Patent Number: 5,024,351

[45] Date of Patent: Jun. 18, 1991

[54] DISPENSER DEVICE FOR REMOVING PLANAR PANELS FROM A HOPPER

[75] Inventors: Byron L. Lowe; Robert T. Lewis; Kenneth M. Milliner; Everett N. Finn, all of Macon, Ga.

[73] Assignee: Brown & Williamson Tobacco Corporation, Louisville, Ky.

[21] Appl. No.: 485,022

[22] Filed: Feb. 26, 1990

[51] Int. Cl.[5] ..... B65G 59/00; B65H 3/00

[52] U.S. Cl. ..... 221/277; 221/289; 221/298; 493/122

[58] Field of Search ..... 221/224, 236, 259, 262, 221/273, 275, 277, 279, 289, 290, 292, 293, 295, 297, 298; 53/157, 398; 493/90, 126, 122

[56] References Cited

U.S. PATENT DOCUMENTS

| | | | |
|---|---|---|---|
| 3,158,289 | 11/1964 | Van Brunt | 221/289 X |
| 3,175,728 | 3/1965 | Lindsey et al. | 221/298 X |
| 3,203,588 | 8/1965 | O'Neal | 221/298 X |

FOREIGN PATENT DOCUMENTS

| | | | |
|---|---|---|---|
| 1069973 | 1/1984 | U.S.S.R. | 221/298 |

*Primary Examiner*—Robert P. Olszewski
*Assistant Examiner*—Tuan N. Nguyen
*Attorney, Agent, or Firm*—Charles G. Lamb

[57] ABSTRACT

A dispenser device for removing planar panels from a hopper is provided with a panel engagement drum located at the discharge of the hopper which includes friction surfaces at spaced apart locations around the perimeter for sequentially engaging subsequent bottom-most panels in the hopper and extracting them from the hopper as the drum continuously rotates. A positioner is engagable with disengagable from the bottom-most panel at the hopper discharge end to position the bottom-most spacer at a location to be engaged by the friction surfaces of the drum. A stop is operatively responsive with the positioner for engagement with the penultimate one of the panels for preventing the penultimate one of the panels from moving to the location of the positioner during the time period the positioner is in its panel disengaged position.

5 Claims, 2 Drawing Sheets

DISPENSER DEVICE FOR REMOVING PLANAR PANELS FROM A HOPPER

BACKGROUND OF THE INVENTION

The present invention relates to devices for removing planar panels, such as cards or sheets of material from a supply hopper containing a plurality of such panels and more particularly to a dispenser device for removing planar panels sequentially one at a time from a hopper containing a plurality of panels. For example, panels such as cards or sheets of material are used in the manufacture of packaging for various goods. The panels or cards of material are used to construct the container for the goods or as partitions or spacers within the container to separate the goods within the container from each other.

In a high volume manufacturing environment, it is a problem to rapidly remove such panels from a supply of panels and feed them one at a time to a workstation for assembly into a package. And, various devices have been proposed to accomplish this task.

U.S. Pat. No. 2,456,449 issued on Dec. 14, 1948 to Ruan et al. is directed to a device for removing a card from the bottom of a stack of cards and inserting the card into the fold of a folded sheet. The stack of cards is in an open bottom hopper. A wheel or stripper disc is located beneath the open end of the hopper to engage the bottom-most card in the hopper. As the disc rotates through a quarter turn it extracts a card from the hopper. A linearly moving ram contacts the trailing edge of a card from the hopper and pushes it into a fold of a folded sheet. The disc has a pinion gear which is engaged by a rack gear to rotate the disc through quarter turns.

U.S. Pat. No. 3,694,994 issued on Oct. 3, 1972 to Henry Morgan Corderoy is directed to a device for removing flat spacers from the open bottom of a magazine. The device is a feed plate which moves transversly across the bottom end of the magazine and pushes the bottom-most spacer into a set of jaws located next to the magazine.

U.S. Pat. No. 3,803,993 issued on Apr. 16, 1974 to Robert H. Graham is directed to a horizontally reciprocable table or blade which moves across the open bottom end of a hOpper to remove the bottom-most one of a panel or sheet of cardboard from the hopper.

U.S. Pat. No. 4,023,328 issued on May 17, 1977 to Calvert et al. is directed to an angled hopper having an open bottom end for holding a stack of spacers or blanks. A pair of suction cups are mounted to a moving belt. The belt reciprocates back and forth bringing the suction cups into engagement with the bottom-most one of the spacers in the hopper. As the suction cups move away from the hopper they extract a spacer from the hopper.

SUMMARY OF THE INVENTION

The present invention provides a dispenser device for removing planar panels one at a time from a feed hopper containing a plurality of panels in end-to-end relationship comprising a panel engagement drum located at the discharge of the feed hopper having a peripheral direction of rotation in generally tangential alignment with the direction of discharge of the panels from the hopper, means for continuously rotating the panel engagement drum, friction means located at spaced apart intervals around the perimeter of the panel engagement drum for sequentially engaging the subsequent bottom-most panel in the hopper and extracting the panel from the hopper as the drum continuously rotates, a positioner movable between a panel engagement position and a panel disengagement position to engage and disengage the panel at the hopper discharge and locate the panel at a predetermined position to be engaged by the friction means of the drum, positioner activating means operative in response to the rotation of the drum for activating the positioner between panel engagement and disengagement positions in timed relationship with the movement of the friction means of the drum past the discharge end of the hopper, and stop means operatively responsive to the movement of the positioner of engagement with the penultimate one of the panels to prevent the penultimate one of the panels from moving to the location of the positioner during the time period the positioner is in the panel disengagement position.

BRIEF DESCRIPTION OF THE DRAWINGS

A better understanding of the invention will be had upon reference to the following description in conjunction with the accompanying drawings wherein like numerals refer to like parts throughout the views and in which.

DETAILED DESCRIPTION OF THE PREFERRED EMBODIMENT

Figure 1:
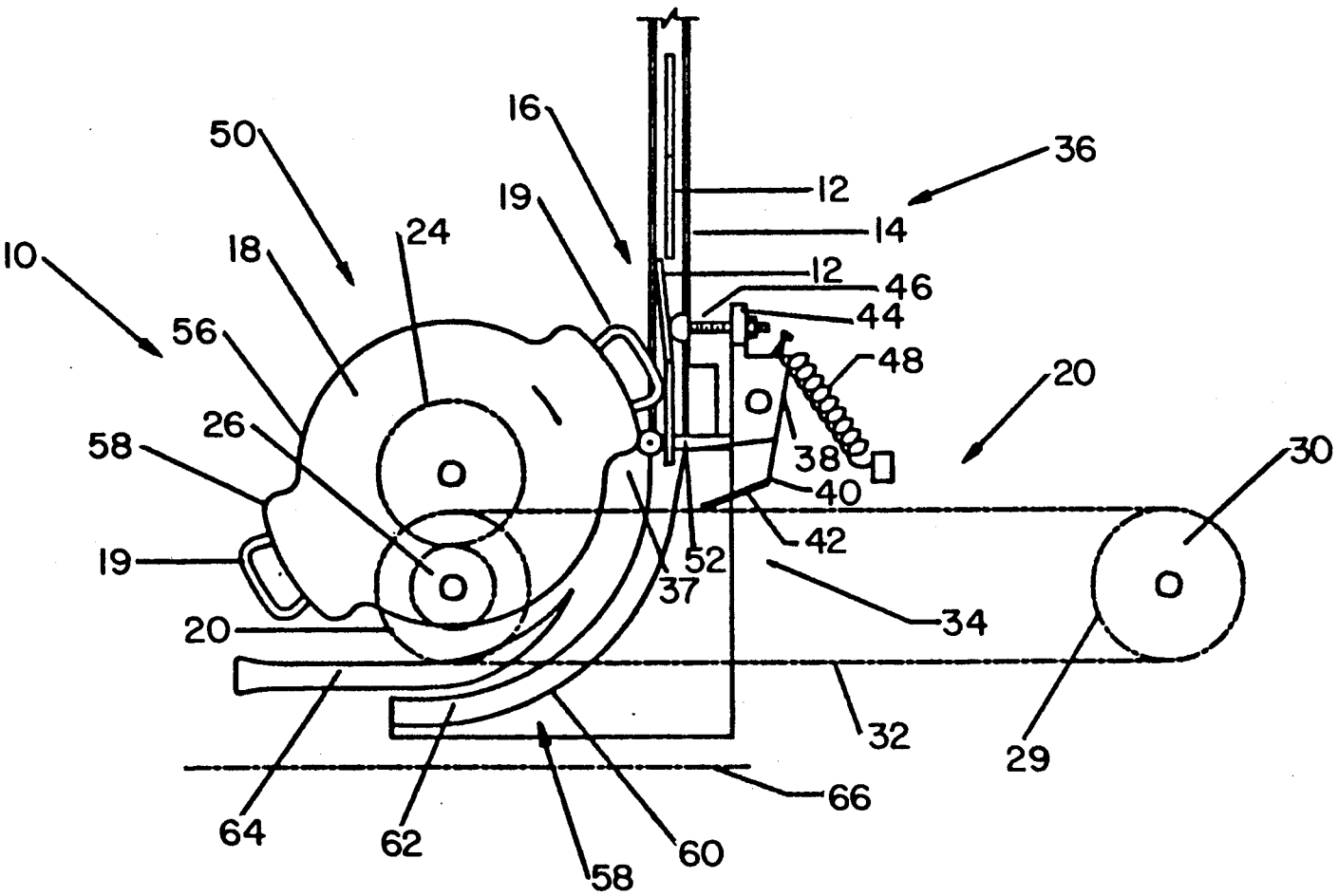
FIG. 1 is a schematic side view of the dispenser device of the present invention as it is about to begin extraction of a panel from a panel supply hopper.
Figure 3:
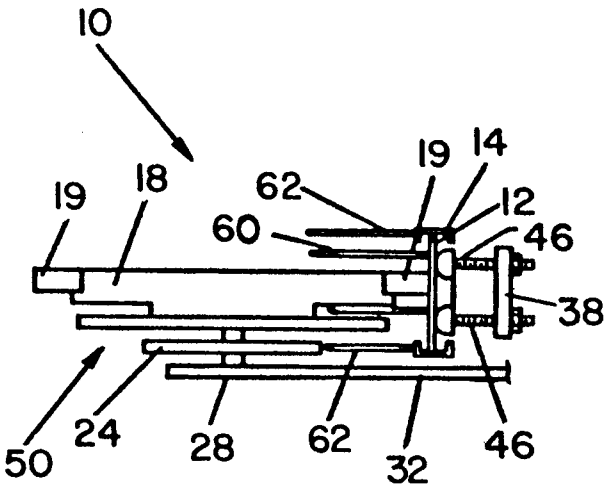

With reference to the Figures, there is shown a dispenser device, generally denoted as the numeral 10, for removing planar panels 12 one at a time from a feed hopper 14 in which a plurality of panels are stored. As shown, the feed hopper 14 is vertically oriented with its discharge 16 located at the bottom of the hopper 14 and containing the panels 12 in end-to-end vertical stacked relationship.

The dispenser device 10 comprises a panel extracting drum 18 disposed at the discharge 16 of the hopper 14. The panel extracting drum 18 is shown having a horizontal axis of rotation with its periphery adjacent the hopper discharge 16 such that peripheral direction of rotation of the drum 18 is in generally tangential alignment with the direction of discharge of the panels 12 from the hopper 14.

Friction means 19 are located at spaced apart intervals around the perimeter of the drum 18 for sequentially contacting the subsequent bottom-most panels 12 in the feed hopper 14 as the drum 18 rotates, and extracting the panel 12 from the hopper 14. As shown, the friction means 19 includes two pads of, for example, rubber spaced apart from each other by 180° around the perimeter of the drum 18.

The panel extracting drum 18 is continuously rotated by drive means, generally denoted as the numeral 20 in FIG. 1. The drive means 20 is shown as including a driven gear 24 coaxially affixed to the extracting drum 18, a drive gear 24, a drive belt sheave 28 coaxially connected to the drive gear 26, a motor 30, and a drive belt 32 interconnecting a belt sheave 29 on the output shaft of the motor 30 to the drive belt sheave 28. Thusly, the extracting drum 18 is continuously driven at a constant speed by the drive motor 30.

Positioner means, generally denoted as the numeral 34, is located at the discharge end 16 of the hopper 14 for alternately engaging and disengaging the bottom-most panel 12 in timed relationship to the rotation of the panel extracting drum 18 such that the positioner means 34 disengages from a bottom-most panel 12 as the drum positions a friction pad 19 in contact with the bottom-most panel 12, and engages the subsequent bottom-most panel 12 as the drum continues to rotate moving the previous bottom-most panel 12 contacted by the friction pad 19 away from the hopper discharge end 16.

Stop means, generally denoted as the number 36, is also positioned proximate the hopper discharge end 16 and is operatively responsive to the positioner means 34 for alternately engaging and disengaging the penultimate one of the panels 12 for preventing the penultimate panel 12 from moving to the location of the positioner means 34 when the positioner means 34 is in the panel disengaging position and allowing the penultimate panel 12 to move to the location of the positioner means 34 when the positioner means 34 is in the panel engaging position.

Toward these objectives, the positioner means 34 and stop means 36 synchronously operate with each other in timed relationship to the rotation of the extracting drum 18, and, more particularly, to the movement of the friction means 19 at the perimeter of the extracting drum 18 into contact with the bottom-most one of the panels 12 by activating means 37. As can be best seen in FIGS. 1 and 2, the activation means 37 comprises a rocker arm 38 which is pivotably mounted to a framework of the dispenser device between its ends for pivotable movement. The positioner means 34 is located at the lower end 40 of the rocker arm 38 and is illustrated as a flange or shelf 42 which projects outwardly at, for example, 90° to the rocker arm 38 toward the hopper discharge end 16. The stop means 36 is located at the upper end 44 of the rocker arm 38 and is illustrated as a spring loaded rod 46 which projects outwardly at, for example, 90° to the rocker arm 38 toward the hopper 14. The rocker arm 38 is biased in a direction to pivot the rocker arm in a direction to move the position means 34 into contact with the bottom-most panel 12 and move the stop means 36 out of contact with the penultimate one of the panels 12 in the hopper 14. This is accomplished by, for example, a tension coil spring 48 connected at one of its ends to the framework of the dispenser device. A radial cam 50 is coaxially associated with the extracting drum for rotation therewith. A cam follower 52 is attached to the rocker arm 38 and is in contact with the cam surface of the radial cam 50 so that the rocker arm 38 is pivoted in timed relationship to the rotation of the extracting drum 18. The cam development provides a feed portion 54 which coincides with the location of the friction pads 19 at the perimeter of the drum 14 to move the positioner means 34 out of engagement with the bottom-most panel 12 at the hopper discharge end 16 and concurrently move the stop means 36 into engagement with the penultimate one of the panels 12 at the hopper discharge end 16 as the drum 18 positions a friction pad 19 into contact with the bottom-most panel 12. The cam development also provides a dwell portion 56 which coincides with the space between friction pads 19 at the perimeter of the drum 14 to move the positioner means 34 into engagement with the bottom-most panel 12 at the hopper discharge end 16 and concurrently move the stop means 36 out of engagement with the penultimate one of the panels 12 at the hopper discharge end 16 as the drum 18 moves the bottom-most panel 12 out of and away from the hopper discharge end 16. In operation, as the drum 18 rotates, the cam feed portion 54 pushes the cam follower 52 causing the rocker arm 38 to pivot against the biasing force of the spring 48 moving the flange or shelf 42 away from the hopper discharge end 16 releasing the bottom-most one of the panels 12 and at the same time, moving the free end of the rod 46 engaging contact against the penultimate panel 12 thus pushing it against the wall of the hopper 14 holding it in place preventing it from falling downwardly in the hopper 14. As the drum 18 continues to rotate, the cam follower 52 leaves the cam feed portion 54 and enters the cam dwell portion 56 of the cam development. As the cam follower 52 moves onto the cam dwell portion 56, the biasing force of the spring 48 causes the rocker arm 38 to pivot in the other direction moving the flange or shelf 42 toward the hopper discharge end 16 to catch and support the edge of the penultimate panel 12 as it will fall to the hopper discharge end 16 and at the same time moving the free end of the rod 46 away from the hopper 14 and out of engaging contact with the penultimate panel 12 allowing the penultimate panel 12 to fall in the hopper to the discharge end 16, whereat the edge of this panel contacts the shelf 42 of the positioning means 34 positioning this panel 12 at the hopper discharge end 16 for subsequent engagement by the next rubber pad 19 of the friction means.

Figure 2:
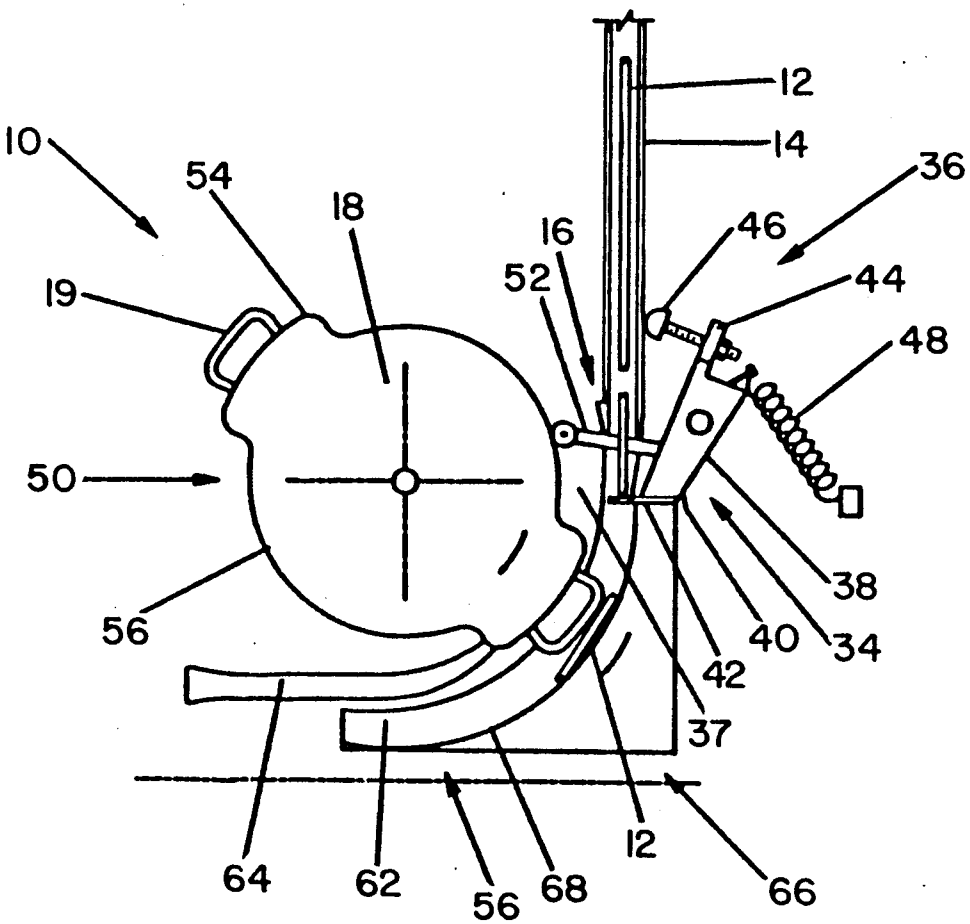
FIG. 2 is a schematic side view of the dispenser device as it is extracting a panel from the panel supply hopper; and, FIG. 3 is a schematic top view of the dispenser device as seen in the direction of arrows 3—3 in FIGS. 1 and 2.

With continued reference to FIGS. 1 and 2, a panel guide, generally denoted as the numeral 58, extends from approximately the hopper discharge end 16 for supporting the panel 12 extracted from the hopper against the friction means 19 at the perimeter of the drum 18 for a preselected sector thereof. As shown, the panel guide 58 includes an arcuate plate 60 extending from the location of the positioner means 34 along a sector of the drum 18 less than 90 degrees and spaced from the perimeter of the drum 18 by a dimension slightly larger than the thickness of a panel 12 so that the panel 12 functionally engaged with the friction pad 19 will slide in the space and be held against the friction pad 19. As shown, the panel guide 58 further includes panel side plates 62 at opposite lateral sides of the arcuate plate 60 to contain the panel 12 in alignment on the arcuate plate as it moves in the space between the arcuate plate 60 and panel extracting drum 18. A doctor blade 64 can be located at the discharge end of the panel guide 58 for assuring separation of the panel 12 from the friction pad 19 as the panel exits the panel guide 58. A conveyor or other workstation, generally denoted as the numeral 66, can be located beneath the dispenser device 10 at the discharge from the panel guide 58 for receiving the panels 12 discharged therefrom.

Therefore, it can be appreciated that the dispenser device 10 of the present invention continuously extracts panels 12 one at a time from the hopper 14 and discharges the extracted panels in a position turned through an angle, for example, 90 degrees from the position of the panels 12 in the hopper 14.

The foregoing detailed description is given primarily for clearness of understanding and no unnecessary limitations should be understood therefrom for modifications will become obvious to those skilled in the art upon reading this disclosure and may be made without departing from the scope of the invention or scope of the appended claims.

What is claimed is:

1. A dispenser device for removing planar panels one at a time from a feed hopper in which the panels are stored in end-to-end vertical relationship comprising:

a panel engagement drum disposed at the discharge end of the feed hopper having a peripheral direction of rotation in adjacent tangential alignment with the direction of discharge of the panels from the feed hopper;

means for continuously rotating the panel engagement drum;

friction means located at preselected spaced apart intervals around the perimeter of the panel engagement drum for sequentially frictionally engaging subsequent bottom-most panels in the hopper and sequentially extracting the panels from the hopper as the drum continuously rotates;

positioner means, alternately movable between panel engagement and panel disengagement positions for engagement and disengagement with the bottom-most panel at the hopper discharge for positioning the bottom-most panel for engagement by the friction means of the drum; and, stop means operatively responsive to the movement of the positioner means alternatively movable between panel disengagement and engagement positions for engagement with the penultimate one of the panels in the hopper when the positioner means is in the panel disengagement position and for disengagement with a penultimate panel when the positioner means is in the panel engagement position.

2. The dispenser device of claim 1, further comprising activating means associated with the positioner means and operative in response to the rotation of the extracting drum for activating the positioner means between panel engagement and panel disengagement positions.

3. The dispenser device of claim 2, wherein the activating means is associated with the stop means for activating the stop means to move to the panel engagement position when the panel positioner means is moving to the panel disengagement position and moving to the panel disengagement position when the panel position means is moving to the engagement position.

4. The dispenser device of claim 3, wherein the activating means comprises:

a cam associated with the extracting drum for rotation therewith; and, a cam follower associated with the positioner means and stop means for moving the positioner means and stop means in response to the rotation of the extracting drum.

5. The dispenser device of claim 1, further comprising a panel guide extending from proximately the positioning means a preselected sector around the perimeter of the extracting drum for holding the extracted panel against the perimeter of the extracting drum.

* * * * *